US005446249A

United States Patent [19]

Goodman et al.

[11] Patent Number: 5,446,249

[45] Date of Patent: Aug. 29, 1995

[54] DRY ACOUSTIC SYSTEM PREVENTING CONDENSATION

[75] Inventors: Seth D. Goodman, Madison; Richard A. Hoffmann, Stoughton, both of Wis.

[73] Assignee: Digisonix, Inc., Middleton, Wis.

[21] Appl. No.: 90,741

[22] Filed: Jul. 13, 1993

[51] Int. Cl.[6] ..... F01N 1/06

[52] U.S. Cl. ..... 181/206

[58] Field of Search ..... 181/206, 156, 149; 381/71

[56] References Cited

U.S. PATENT DOCUMENTS

| | | | |
|---|---|---|---|
| 4,665,549 | 5/1987 | Eriksson et al. | 381/71 |
| 5,044,464 | 9/1991 | Bremigan | 181/206 |
| 5,063,598 | 11/1991 | Geddes | 381/71 |
| 5,088,575 | 2/1992 | Eriksson | 181/206 |
| 5,097,923 | 3/1992 | Ziegler et al. | 181/206 |
| 5,176,114 | 1/1993 | Brackett | 181/206 X |

OTHER PUBLICATIONS

S. Himori, H. Saito and S. Onizawa, "Loudspeaker for High Temperature Environment", International Symposium on Active Control of Sound and Vibration, Apr. 9–11, 1991, Tokyo, Japan (and English language translation).

*Primary Examiner*—Khanh Dang

*Attorney, Agent, or Firm*—Andrus, Sceales, Starke & Sawall

[57] ABSTRACT

An active noise control system is provided for cancellation of noise in a duct. A speaker is mounted over an opening in the duct. An enclosure is mounted the duct about the speaker. Air flow is generated through the enclosure in order to balance the diffusion of water vapor through the speaker such that the dew point of the air in the enclosure is always below the temperature of the air in the enclosure, thus avoiding condensation.

29 Claims, 1 Drawing Sheet

DRY ACOUSTIC SYSTEM PREVENTING CONDENSATION

BACKGROUND OF THE INVENTION

This invention relates to acoustic systems and more particularly to acoustic systems having transducers, such as speakers in active noise control systems, operating in a wet environment or otherwise subject to condensation.

When used in an environment where the air is saturated with water vapor, transducers for active noise control systems must either be unaffected by the moisture or impervious to it. Conventional loudspeakers consist of a rigid cone suspended from a frame by a flexible surround. While it is possible to construct the cone from a rigid material, such as stainless steel, that is impermeable to water vapor, the surround must be flexible and is normally substantially permeable to water vapor. Loudspeakers have been constructed whose cones and surrounds were fabricated from titanium, and thus were impermeable to water vapor. However, the cone excursion was severely limited.

Alternative solutions use conventional loudspeakers with protective coatings, or elastic membranes in front of the speakers and the microphones. Similar to the problem with the flexible surround, it has proven difficult to design a coating or membrane with sufficiently low vapor transmission, low acoustic losses, low acoustic mass, high linearity of compliance, long excursion and long service life. The problem is compounded by the fact that the inner surface of the transducer enclosure is typically cooler than the duct interior. Water vapor diffuses through the speaker or protective membrane and condenses in the cooler transducer enclosure. Over time, water accumulates in the transducer enclosure.

An additional difficulty is that it is not practical to operate a totally sealed transducer enclosure in a system that operates at a static pressure different than the pressure in the enclosure. This is particularly true for loudspeakers where, due to the low compliance, static pressure differences of only a few inches of water will displace the cone and voice coil out of its operating region. This not only prevents the normal operation of the speaker, but, when carried to extremes, can damage it. The pressure difference between the inside of the transducer enclosure and the duct interior can increase during operation due to temperature changes, duct pressure changes and power dissipation inside the enclosure itself. It is therefore desirable to equalize pressure between the transducer enclosure and the duct interior.

SUMMARY OF THE INVENTION

This invention solves both the problem of residual moisture that diffuses through permeable speaker surrounds, protective coatings or membranes and the problem of equalizing the pressure between the transducer enclosure and the duct interior. The drier system includes a duct defining a transmission path for an acoustic wave, and an acoustic transducer to interact with the wave in the duct. The transducer is housed within the interior of an enclosure. Two acoustic elements are provided which have very high acoustic impedance at the transducer operating frequency, the first element having a high restriction to the steady flow of air and the second having a low restriction to the steady flow of air. Dry compressed air is supplied to the interior of the enclosure through the first acoustic element. The pressure drop across the first element must be large as compared to any fluctuations in the duct pressure and air supply pressure so that the flow of air into the enclosure is nearly constant. The second element, which has very low restriction to steady flow, communicates between the interior of the enclosure and the duct in order to equalize the pressure therebetween. Both acoustic elements are provided with a very high acoustic impedance to ensure that they do not adversely load the transducer at the operating frequency.

In operation, a steady flow of dry air flows through the transducer enclosure into the duct. The flow of dry air must be sufficient to balance the diffusion of water vapor through the speaker such that the dew point of the air in the enclosure is always below the temperature of the air in the enclosure, thus avoiding condensation. The dew point of the air in the enclosure must also stay below the temperature of the enclosure wall to avoid condensation. The inlet dry air need not be completely dry, as long as its dew point is below the required final dew point of the air in the enclosure. The lower the dew point of the inlet air, the less flow is required to achieve a given final dew point of air in the enclosure. The flow rate required is determined by the dew point and temperature of the inlet air, the rate of water vapor and heat transmission into the enclosure and the required final dew point in the enclosure.

In a second embodiment, the drier system includes a duct defining a transmission path for an acoustic wave, and an acoustic transducer within an enclosure attached to the duct to interact with the wave. The transducer is separated from the duct by a membrane, with a separation chamber between the membrane and the transducer. Like the previous embodiment, an air flow structure is provided to maintain a steady flow of air through the enclosure and separation chamber and into the duct. The air flow structure is comprised of a first acoustic element supplying air to the interior of the enclosure, a second acoustic element communicating between the interior of the enclosure and the interior of the chamber, and a third acoustic element communicating between the chamber and the duct. The first, second and third acoustic elements all have a high acoustic impedance at the transducer operating frequency. The first element has a high restriction to the steady flow of air while the second and third have a low restriction.

In operation, a steady flow of dry air is provided into the transducer enclosure through the first acoustic element. The pressure drop across the first acoustic element is substantially larger than any pressure fluctuation in the duct or air supply so as to ensure that the flow of air into the enclosure is constant. The air flows through the second and third acoustic elements into the duct. The second element equalizes the pressure between the interior of the enclosure and the separation chamber. Likewise, the third acoustic element equalizes the pressure between the chamber and the duct.

As in the first embodiment, the flow of air through the enclosure and the separation chamber must be sufficient to balance the diffusion of water vapor through the membrane such that the dew point of the air in the enclosure is always below the temperature of the air in the enclosure, and the dew point of the air in the separation chamber is always below the temperature of the air in the chamber, thus avoiding condensation. The dew point of the air in the enclosure must also stay below the temperature of the enclosure wall to avoid condensation. The inlet dry air need not be completely dry, as long as its dew point is below the required final dew point of the air in the enclosure and the separation chamber.

A further embodiment is used when the static pressure of the duct interior is very close to ambient and the resulting small pressure differential between the duct and the enclosure will not adversely affect the transducer operation. In this case, an acoustic element with low restriction to steady flow communicates between the interior of the transducer enclosure (or separation chamber) and outside ambient atmosphere, instead of the duct interior. Instead of providing dry compressed air into the enclosure, a vacuum source is provided to draw air from the enclosure through an acoustic element with high restriction to steady flow. In situations where the duct is an internal combustion engine exhaust pipe, the engine intake manifold may be used as the vacuum source.

Therefore it is an objective of this invention to develop a drier system for an active noise control transducer in a wet environment.

Another objective of this invention is to develop a drier system wherein the pressure within the transducer enclosure is equal to the pressure within the duct interior.

These and other objectives will become evident through this disclosure.

DETAILED DESCRIPTION

Figure 1:
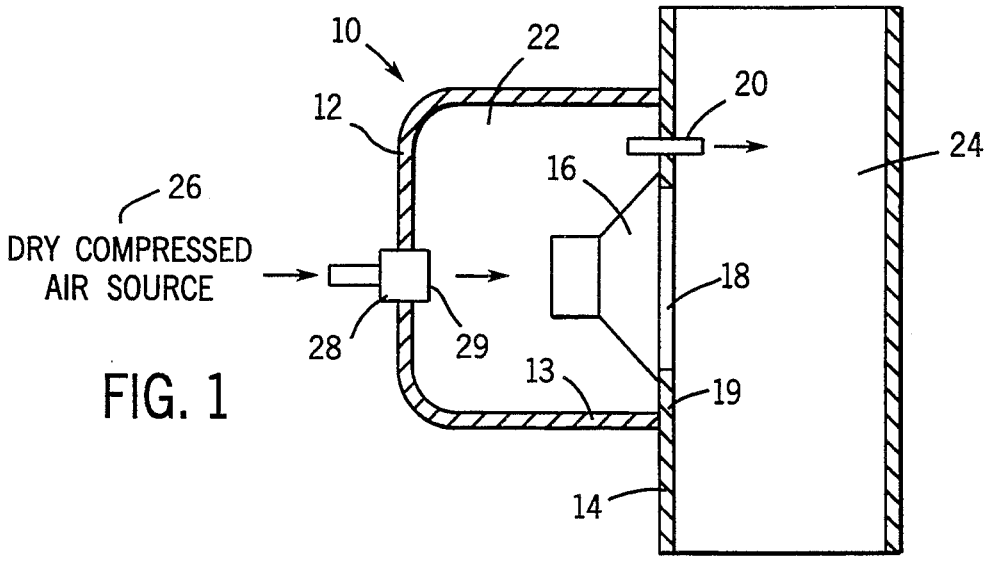
FIG. 1 is a schematic illustration of the acoustic noise control apparatus constructed in accordance with the invention.

An acoustic system, including a transducer drier, is generally designated by the reference numeral 10. The system 10 is comprised of an enclosure 12 affixable to a duct 14. The duct defines a transmission path for an acoustic wave. Within the enclosure 12, a transducer, such as a speaker 16, is mounted to the duct 14 over an opening 18 in the duct wall 19. A dry compressed air source 26 directs dry air into the interior 22 of enclosure 12 through an acoustic element, a flow regulator 28. A second acoustic element, for example, a hollow tube 20, interconnects the interior 22 of the enclosure 2 and the interior 24 of the duct 14.

Figure 2:
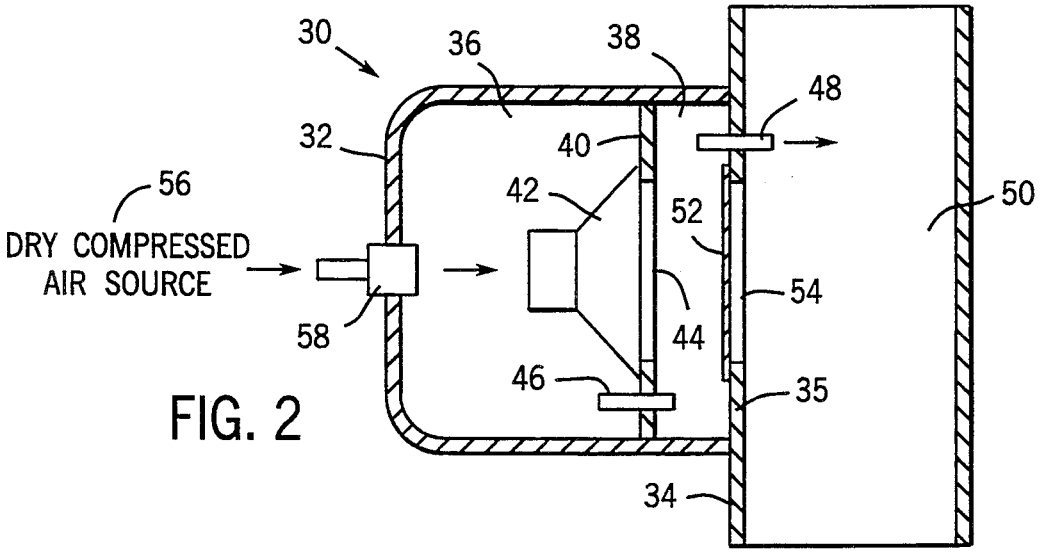
FIG. 2 is a view like FIG. 1 and shows an alternate embodiment.

A second embodiment is shown in FIG. 2. The device is generally designated by the reference numeral 30. The device 30 is comprised of an enclosure 32 affixed to a duct 34. The enclosure 32 has two interior sections 36 and 38. The sections 36, 38 are divided by partition 40. A speaker 42 is mounted over an opening 44 in the partition 40. A hollow tube 46 interconnects the interior enclosure section 36 to the interior enclosure section 38. Likewise, a hollow tube 48 interconnects interior enclosure section 38 with the interior 50 of duct 34. A membrane 52 is placed over opening 54 in the duct wall 35 to separate interior enclosure section 38 from the interior 50 of duct 34. A dry compressed air source 56 directs dry air through a flow regulator 58 into the enclosure 32.

Figure 3:
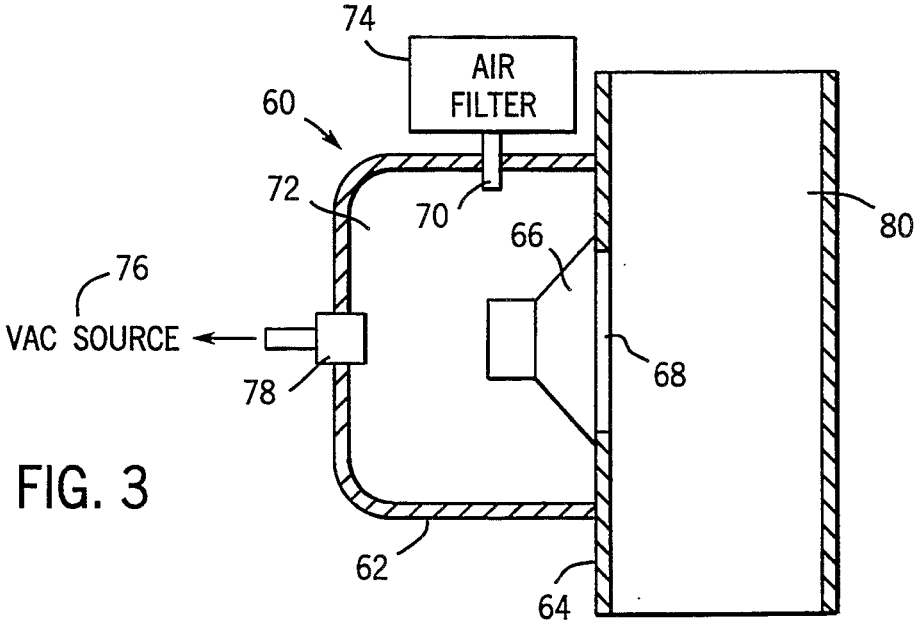
FIG. 3 is a view like FIG. 1 and shows an alternate embodiment.

In a third embodiment designated by the reference numeral 60, FIG. 3, an enclosure 62 is affixed to duct 64. A speaker 66 is mounted over an opening 68 in the duct 64. A hollow tube 70 is provided to allow air into the interior 72 of enclosure 62. The air is purified by an air filter 74. A vacuum source 76 is provided to draw air through a flow regulator 78 from the interior 72 of the enclosure 62.

Referring to FIG. 1, in operation, the dry compressed air source 26 generates a steady pressure of dry air. This dry air flows through flow regulator 28 into the interior 22 of enclosure 12 and then flows through tube 20 into the interior 24 of duct 14. The flow of dry air through enclosure 12 must be sufficient to balance the diffusion of water vapor through the speaker 16 such that the dew point of the air in the enclosure 12 is always below the temperature of the air in the enclosure, thus avoiding condensation. The dew point of the air in the enclosure must also stay below the temperature of the inner wall 13 of the enclosure 12 to avoid condensation. The inlet dry air need not be completely dry, as long as its dew point is below the required final dew point of the air in the enclosure 12. The lower the dew point of the inlet dry air, the less flow is required to achieve a given final dew point of air in the enclosure 12.

A flow regulator 28 is chosen to maintain a relatively constant air flow into the enclosure 12 from dry air source 26. If the air supply 26 is of approximately constant pressure, the flow regulator 28 may consist simply of a flow restrictor, which may take the form, among others, of a narrow I.D. (inner diameter) tube, an orifice or a frit. In this case, the pressure drop across the regulator 28 must be large as compared to any fluctuations in the duct interior 24 pressure or air source 26 pressure so that the flow is nearly constant. The regulator 28 must also present a high enough acoustic impedance to the enclosure 12 so that it does not adversely load the speaker 16. In practice, the regulator 28 should have an acoustic impedance of at least five times the driving point impedance of the enclosure 12 as seen by the speaker 16. Since there is a large gas expansion occurring in the regulator 28, care must be taken to avoid ice formation at the regulator outlet 29. If necessary, a heater may be used to prevent ice formation at the regulator outlet 29. Alternatively, the motor or pump driving the dry compressed air source 26 may be located near the regulator 28 to warm the latter.

The tube 20 is chosen to have very low flow restriction so that the pressure in the enclosure 12 is only a small amount higher than in the duct. The tube 20 must also have sufficiently high acoustic impedance so that it does not adversely load the speaker 16. The criterion for the acoustic impedance of tube 20 is the same as that given for flow regulator 28, above.

FIG. 2 shows a modification of the active noise control system in the case where a membrane 52 is placed in front of the speaker 42. The dry compressed air source 56 generates a steady flow of dry air through flow regulator 58, through tubes 46 and 48 and into the interior 50 of the duct 34. The flow of air must be sufficient to balance the diffusion of water vapor through the membrane 52 and the speaker 42 such that the dew point of the air in the enclosure 32, in sections 38 and 36, is always below the temperature of the air in the respective sections of the enclosure, thus avoiding condensation.

The regulator 58 chosen must present a high enough acoustic impedance to the enclosure 32 so that the speaker 42 is not adversely loaded. In practice, the regulator 58 should have an acoustic impedance of at least five times the driving point impedance of the enclosure 32 as seen by the speaker 42.

Tubes 48 and 46 are chosen to have a very low flow restriction so the pressures in respective sections 38 and 36 of the enclosure 32 are only a small amount higher than in the interior 50 of the duct 34. In addition, tubes 48 and 46 must also have sufficiently high acoustic impedance so that they do not adversely load the speaker 42. The acoustic impedance of tubes 46 and 48 should be sufficiently high that only a small fraction of the acoustic volume velocity produced by speaker 42 will flow through tubes 46 and 48.

When the static pressure of the duct interior is very close to ambient and the resulting small pressure differential would not adversely affect the speaker operation, the embodiment shown in FIG. 3 may be used. In this embodiment, tube 70 connects the interior 72 of the enclosure 62 with the outside ambient atmosphere instead of the duct interior 80. A filter 74 purifies the air as the air enters enclosure 62. This is advantageous in that there is no way for gases or other contaminants to inadvertently enter the enclosure 62 from the interior 80 of the duct 64. Vacuum source 76 draws air through regulator 78 from the interior 72 of enclosure 62. Tube 70 is chosen to have low flow restriction so that the pressure inside enclosure 62 is only slightly below outside ambient pressure. Flow regulator 78 is chosen to maintain a constant air flow out of enclosure 62 to vacuum source 76. For the case of a constant pressure vacuum source 76, the flow regulator 78 may consist simply of a flow restrictor which may take the form, among others, of a narrow I.D. tube, an orifice or a frit. In this case, the pressure drop across regulator 78 must be large as compared to any fluctuations in enclosure pressure or vacuum source pressure so that the flow is nearly constant. The regulator must also present a high enough acoustic impedance to the enclosure 62 so that it does not adversely load the speaker 66. It is preferred that the regulator 78 have an acoustic impedance of at least five times the driving point impedance of the enclosure 62 as seen by the speaker 66. Tube 70 should have a similarly high acoustic impedance.

It is recognized that in all the embodiments described, it may be desirable that the flow regulators 28, 58 and 78 are not attached directly to enclosures 12, 32 and 62, but located remotely and connected through a long tube. It is also recognized that an embodiment exists that uses a vacuum source and air filter, as in FIG. 3, and incorporates a membrane and separation chamber, as in FIG. 2.

It is further recognized that for the case of the interior of the transducer enclosure being warmer than the surrounding ambient atmosphere, no special drying means are required for the compressed air source if ambient air is compressed without addition of moisture. This is the case since, even if ambient air is at 100% relative humidity, it will never condense upon entering the warmer enclosure. Alternatively, the dew point of the cooler ambient air is guaranteed to be lower than the temperature of the warmer enclosure.

Therefore, it can be seen that the invention accomplishes at least all of its stated objectives. It is recognized that various alternative embodiments of this invention are possible without varying from the spirit of the invention.

We claim:

1. An acoustic system comprising:

a duct defining a transmission path for an acoustic wave;

an acoustic transducer operating over a range of operating frequencies and mounted to interact with said acoustic wave through an opening in said duct;

a transducer enclosure having an interior containing said transducer;

a first acoustic element providing an air flow path communicating with said interior of said enclosure through a hole in the enclosure, said first element having a high restriction to air flow and a high acoustic impedance at the operating frequencies of said transducer; and a second acoustic element providing an air flow path communicating with said interior of said enclosure through a hole in the duct, said second element having a low restriction to air flow and a high acoustic impedance at the operating frequencies of said transducer.

2. The invention according to claim 1 wherein said first element supplies dry compressed air to said interior of said enclosure at a substantial pressure drop across said first element, anal said second element communicates between said interior of said enclosure and said transmission path in said duct to equalize the pressure therebetween.

3. An acoustic system comprising a duct defining a transmission path for an acoustic wave, an acoustic transducer operating over a range of operating frequencies and mounted in relation to said duct so that said transducer interacts with said acoustic wave through an opening in said duct, a transducer enclosure having an interior containing said transducer, and air flow means for providing a steady flow of air through the interior of said enclosure sufficient to balance diffusion of water vapor into the interior of said enclosure such that the dew point of air in said enclosure is below the temperature of air in the interior of said enclosure, to avoid condensation in the interior of the enclosure.

4. The invention according to claim 3 wherein said air flow means comprises a first acoustic element providing an air flow path communicating with the interior of said enclosure, said first element having a high restriction to air flow and a high acoustic impedance at the transducer operating frequencies, and a second acoustic element providing an air flow path communicating with the interior of the enclosure, said second acoustic element having a low restriction to air flow and a high acoustic impedance at the transducer operating frequencies. operating frequency.

5. The invention according to claim 4 wherein said first acoustic element supplies dry compressed air to said interior of said enclosure at a substantial pressure drop across said first acoustic element, and said second acoustic element communicates between said interior of said enclosure and said flow path in said duct and substantially equalizes the pressure therebetween.

6. The invention according to claim 5 wherein said pressure drop across said first acoustic element is substantially larger than pressure fluctuations in said duct and in said supplied dry air such that there is substantially constant air flow through said first acoustic element, through said interior of said enclosure, through said second acoustic element and into said duct.

7. The invention according to claim 4 wherein said first acoustic element is connected to a source of air at a pressure different than a pressure in said interior of said enclosure.

8. The invention according to claim 7 wherein said second acoustic element communicates between said interior of said enclosure and said transmission path in said duct through it hole in the duct.

9. The invention according to claim 7 wherein said second acoustic element communicates between said interior of said enclosure and outside ambient atmosphere.

10. The invention according to claim 7 wherein said first acoustic element communicates between said interior of said enclosure and the source of dry compressed air.

11. The invention according to claim 7 wherein said first acoustic element communicates between said interior of said enclosure and a vacuum source.

12. The invention according to claim 11 wherein said duct is an internal combustion engine exhaust pipe, and said vacuum source is provided by the engine intake manifold.

13. An acoustic system comprising a duct defining a transmission path for an acoustic wave, an acoustic transducer interacting with said acoustic wave through an opening in said duct, a membrane located over the opening, a separation chamber between the membrane and the acoustic transducer, a transducer enclosure having an interior containing said transducer, and an air flow structure maintaining a steady flow of air through said interior of said enclosure and through said separation chamber sufficient to balance diffusion of water vapor into said chamber and into said enclosure.

14. The invention according to claim 13 comprising a first acoustic element supplying air to said interior of said enclosure through an air inlet into the interior of the enclosure, a second acoustic element communicating between said interior of said enclosure and said chamber through an air outlet from the interior of the enclosure, and a third acoustic element communicating between said chamber and said transmission path in said duct through a hole in the duct.

15. The invention according to claim 14 wherein said first element has a high restriction to air flow, said second and third acoustic elements have a low restriction to air flow, and each of said first, second and third acoustic elements has high acoustic impedance over the range of transducer operating frequencies.

16. The invention according to claim 15 wherein said first acoustic element supplies dry compressed air to said interior of said enclosure at a substantial pressure drop across said first acoustic element, said second acoustic element equalizes the pressure between said interior of said enclosure and said separation chamber, and said third acoustic element equalizes the pressure between said separation chamber and said duct.

17. The invention according to claim 16 wherein said pressure drop across said first acoustic element is substantially larger than pressure fluctuations in said duct and in said supplied dry air such that there is substantially constant air flow through said first acoustic element, through said interior of said enclosure, through said second acoustic element, through said chamber, through said third acoustic element and into said duct, and wherein said flow restriction of said second acoustic element is low enough such that the pressure in said interior of said enclosure is only slightly higher than the pressure in said chamber, and wherein the flow restriction of said third acoustic element is low enough such that the pressure in said chamber is only slightly higher than the pressure in said duct.

18. The invention according to claim 13 wherein said transducer interacts with said acoustic wave in said duct through said separation chamber and said membrane, and wherein said air flow structure comprises a first acoustic element providing an air flow path communicating with said interior of said enclosure through an air inlet to the enclosure, a second acoustic element providing an air flow path communicating between said interior of said enclosure and said separation chamber through an air outlet from the enclosure, and a third acoustic element providing an air flow path communicating with said separation chamber through an air hole in the separation chamber.

19. The invention according to claim 18 wherein said first acoustic element supplies dry compressed air to said interior of said enclosure, and said third acoustic element communicates between said chamber and said duct through a hole in the duct.

20. The invention according to claim 18 wherein said first acoustic element is connected to a vacuum source, and said third acoustic element communicates between said separation chamber and outside ambient atmosphere through an air hole in the separation chamber.

21. In an active acoustic attenuation system for attenuating an acoustic wave propagating in the interior of a duct a transducer enclosure drier system comprising:

an enclosure having an interior;

an acoustic transducer located within the interior of the enclosure that interacts with the acoustic wave through an opening in the duct;

an air inlet to the enclosure;

means for providing dry compressed air into the enclosure through the air inlet;

means for controlling the flow rate of the dry compressed air into the enclosure; and means for equalizing the pressure between the interior of the enclosure and the interior of the duct.

22. The drier system of claim 21 wherein the flow of air into the enclosure balances a diffusion of water vapor through the transducer such that a dew point of the air in the enclosure is below the temperature of the air in the enclosure thereby avoiding condensation.

23. The drier system of claim 21 wherein the air provided into the enclosure has a dew point below a inner wall temperature of the enclosure thereby avoiding condensation.

24. The drier system of claim 21 wherein the flow rate of air into the enclosure is substantially constant.

25. The drier system of claim 21 wherein the means for controlling the flow rate of air into the enclosure has an acoustic impedance of at least five times a driving point impedance of the enclosure as seen by the transducer.

26. The drier system of claim 21 wherein the means for equalizing the pressure between the interior of the enclosure and the interior of the duct is comprised of an acoustic element providing an air flow path between the interior of the enclosure and the interior of the duct.

27. The drier system of claim 26 wherein the acoustic element has an acoustic impedance of sufficient magnitude such that the transducer is not adversely loaded.

28. An active noise control system for a duct comprising:

an enclosure affixable to the duct;

an acoustic transducer within an interior of the enclosure, the acoustic transducer interacting with an acoustic wave propagating in the duct through an opening in the duct;

an air inlet to the enclosure that provides air into the interior of the enclosure;

an air outlet from the enclosure;

a vacuum source that draws air out of the enclosure through the air outlet; and means for controlling the flow rate of the air drawn from the enclosure by the vacuum source.

29. The active noise control system of claim 28 wherein the means for controlling the flow rate of air into the enclosure has an acoustic impedance of at least five times a driving point impedance of the enclosure as seen by the transducer.

* * * * *